United States Patent [19]

Kiefer et al.

[11] Patent Number: 4,674,693

[45] Date of Patent: Jun. 23, 1987

[54] MILL

[75] Inventors: Dieter Kiefer, Wesel-Bislich; Helmut Grommes, Duisburg, both of Fed. Rep. of Germany

[73] Assignee: Deutsche Babcock Werke Aktiengesellschaft, Oberhausen, Fed. Rep. of Germany

[21] Appl. No.: 776,406

[22] Filed: Sep. 16, 1985

[30] Foreign Application Priority Data

Oct. 30, 1984 [DE] Fed. Rep. of Germany ..... 3439659

[51] Int. Cl.[4] ..... B02C 15/00

[52] U.S. Cl. ..... 241/101.2; 241/117; 277/3; 277/15; 277/74; 277/227

[58] Field of Search ..... 241/117-121, 241/285 R, 285 A, 285 B, 101.2, 216, DIG. 30; 277/3, 15, 74, 227, 228

[56] References Cited

U.S. PATENT DOCUMENTS

| | | | |
|---|---|---|---|
| 2,134,876 | 11/1938 | Hull et al. | 241/216 |
| 3,473,743 | 10/1969 | Winter | 241/216 X |
| 4,441,720 | 4/1984 | Dibowski et al. | 277/74 X |

FOREIGN PATENT DOCUMENTS

| | | | |
|---|---|---|---|
| 146766 | 9/1983 | Japan | 277/227 |
| 2130918 | 6/1984 | United Kingdom | 241/117 |

*Primary Examiner*—Mark Rosenbaum
*Attorney, Agent, or Firm*—Max Fogiel

[57] ABSTRACT

Grinding elements of a mill rotating inside a mill housing are sealed off relative to the mill housing by an isolating air chamber. The isolating air chamber is limited by sealing rings abutting against the mill elements and a sealing ring housing. The sealing ring housing is connected to the mill housing. An intermediate insulation is provided between the sealing ring housing and the mill housing. The mill housing is sealed off to the outside by a collar.

9 Claims, 2 Drawing Figures

MILL

BACKGROUND OF THE INVENTION

The present invention relates to a mill of the type known from DE-OS No. 31 41 830 in which the seal consists of a compressible material in the form of an asbestos or ceramic cord. It has the object to seal the isolating air chamber of the mill to the outside in a gastight manner, and to prevent dust from escaping into the atmosphere. The seal is thereby in the position to absorb axial and radial movements, angular displacements, and a combination thereof. These movements can act on the parts coming into contact with one another. Furthermore, the seal has to absorb pressure surges of up to 1 bar and has to cause a reduction in noise. However, the asbestos or ceramic cord has the disadvantage that it hardens and thereby shrinks. In this manner, a gap can form between the cord and the adjacent parts so that leaks are created.

SUMMARY OF THE INVENTION

It is an object of the present invention to improve the sealing of the conventional type of mill.

In the mill, in accordance with the present invention, the intermediate insulation suppresses the transfer of sound conducted through solids and therewith causes a vibration and noise dampening. The intermediate insulation is also able to take up pressure surges to the required extent. The outer lying collar provides a seal for the mill both when operating under super pressure as well as sub-pressure.

An example of an embodiment of the invention is illustrated in the drawing and is explained in more detail hereafter.

DESCRIPTION OF THE PREFERRED EMBODIMENTS

Figure 1:
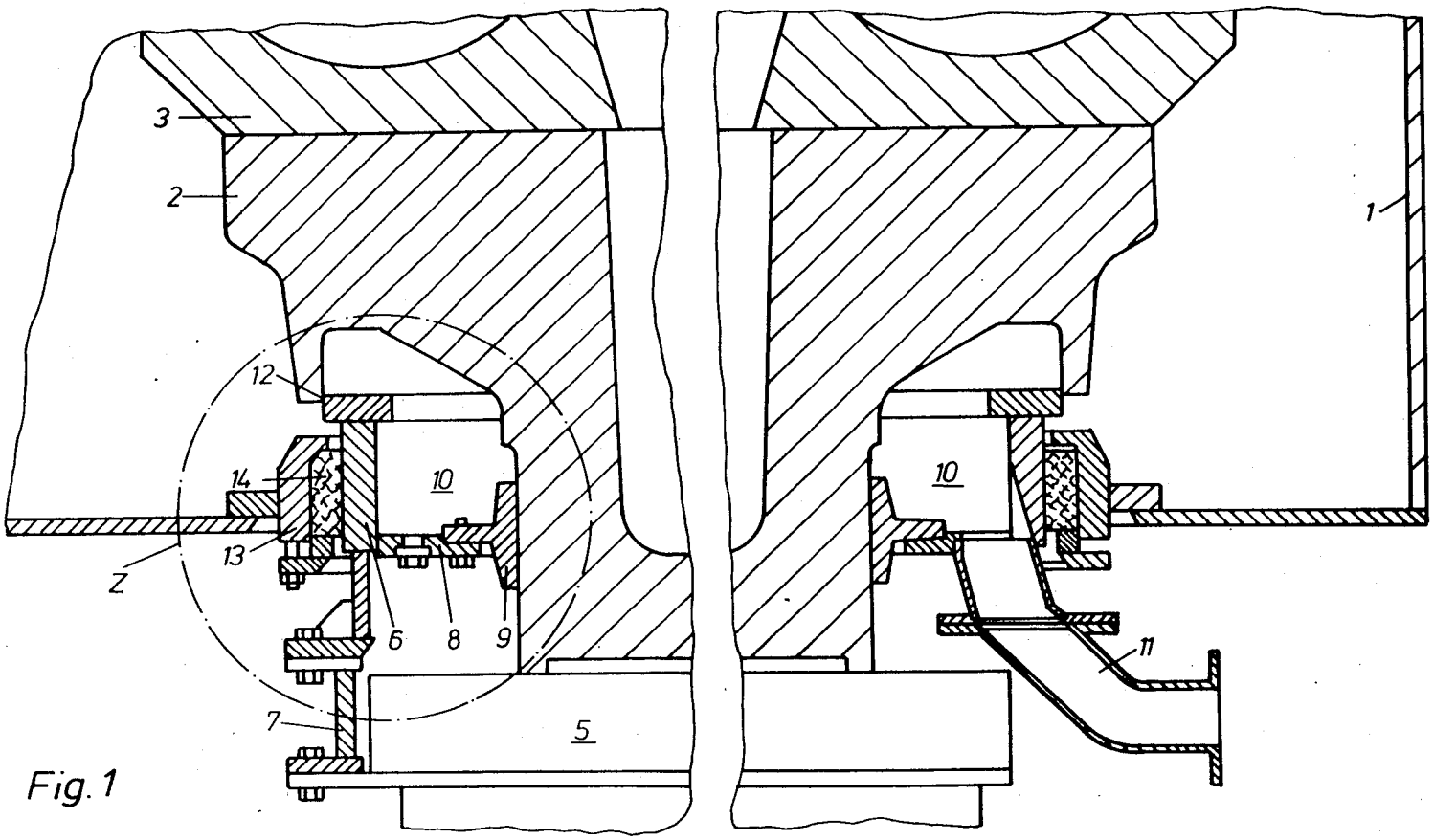
FIG. 1 is a partially longitudinal section through a mill in accordance with the present invention.
Figure 2:
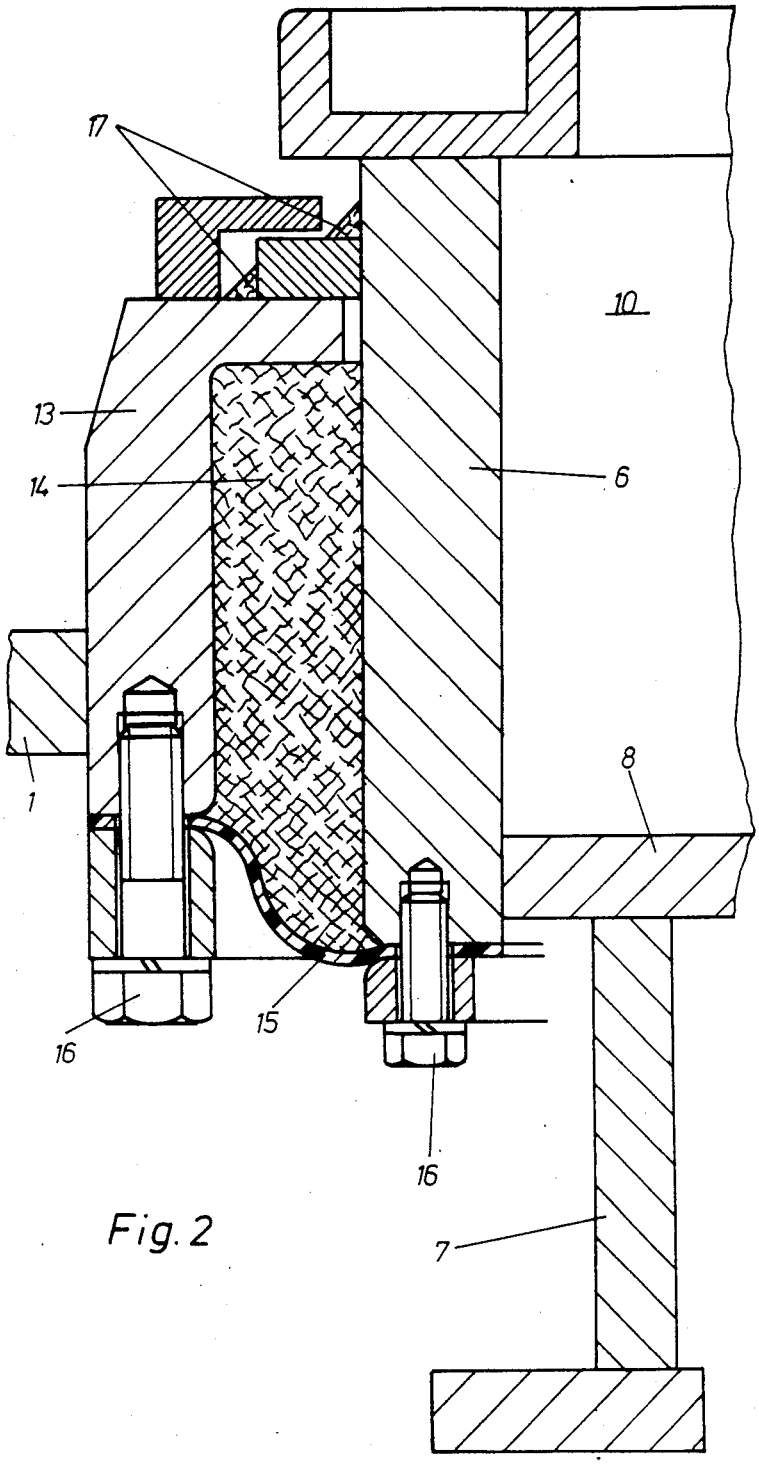
FIG. 2 is a detail Z according to FIG. 1.

A roller bowl mill is illustrated which has, a grinding component, a rotating, vertically arranged grinding bowl 2 within a mill housing 1. The grinding bowl 2 has several grinding plate segments 3, on which stationary grinding rollers, which are not illustrated, roll. The grinding bowl 2 is driven by a motor and via a transmission, of which only the take-off flange 5 is illustrated.

The lower part of the grinding bowl 2 is passed through the milling housing 1 and is sealed off relative to it. For this purpose a sealing ring housing 6 is arranged centrally relative to the grinding bowl 2 and is supported on the housing of the transmission by several supports 7. A camseal 9 is attached at a plate 8 forming the floor of the sealing ring housing 6. The camseal 9 embraces the lower part of the rotating grinding bowl 2 and contains metal rings for example of brass, arranged in several rows above each other.

The stationary sealing ring housing 6 enclosed, together with the camseal 9 and a part of the rotating grinding bowl 2, an isolating air chamber 10, which is provided with an isolating (sealing) air connection 11. Isolating air or another isolating gas which is under a pressure higher than existing in the mill interior, is supplied to the isolating air chamber 10 through the isolating air connection 11. The isolating air passes into the mill interior through a gap 12 between the sealing ring housing 6 and a collar of the grinding bowl 2.

An intermediate insulation 14 is provided between the sealing ring housing 6, and the adjacent part 13 of the mill housing 1. The intermediate insulation 14 consists of mineral wool or another heat insulation material. It can be introduced as plate material or as a shapeless mass.

A collar 15 surrounds the intermediate insulation 14 to the outside. This collar has the form of a sealing ring and is clamped tightly by bolts 16 to the part 13 of the milling housing 1 and to the sealing ring housing 6. A multi-layer elastic material is used for the collar 15, e.g. of polyurethane, if necessary with an aluminum coating. A seal of a fiber sealing mass 17 is provided above the intermediate insulation 14 towards the mill interior between the sealing ring housing 6 and the mill housing 1. The fiber sealing mass is a filler, which acts as insulation and, as displacement body or filter, prevents the exit of dust.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A mill comprising: a mill housing; grinding elements rotating within an interior space of said mill housing; a sealing air chamber; said interior space being sealed off relative to outer atmosphere by said sealing air chamber; a sealing ring housing and sealing rings abutting against said grinding element; said sealing air chamber being bordered by said sealing rings abutting against said grinding elements and said sealing ring housing; said sealing ring housing being joined to said mill housing; an intermediate seal of heat insulating compressible material between said sealing ring housing and said mill housing; a collar of flexible material; said seal of compressible material being formed of an intermediate insulation sealed off to the outside by said collar, said intermediate seal suppressing transfer of sound conducted through solids and dampening vibrations and noise, said intermediate seal also absorbing pressure surges of predetermined magnitude; said collar being a seal during operation of the mill at pressures that are above atmospheric as well as below atmospheric, said intermediate seal being free of a ceramic cord.

2. A mill as defined in claim 1, wherein said intermediate seal comprises mineral wool.

3. A mill as defined in claim 1, wherein said intermediate seal comprises plate material.

4. A mill as defined in claim 1, wherein said collar is comprised of multi-layer elastic material.

5. A mill as defined in claim 4, including an aluminum coating on said multi-layer elastic material.

6. A mill as defined in claim 5, including a fiber sealing mass above said intermediate seal towards the mill interior between said sealing ring housing and said mill housing.

7. A mill as defined in claim 1 including a seal of a fiber sealing mass on a side of said intermediate insulation facing towards the mill interior between said sealing ring housing and said mill housing.

8. A mill comprising: a mill housing; grinding element rotating within an interior space of said mill housing; a sealing air chamber; said interior space being sealed off relative to outer atmosphere by said sealing air chamber; a sealing ring housing and sealing rings abutting against said grinding elements; said sealing air chamber being bordered by said sealing rings abutting against said grinding elements and said sealing ring housing; said sealing ring housing being joined to said mill housing; an intermediate seal of heat insulating compressible material between said sealing ring housing and said mill housing; a collar of flexible material; said seal of compressible material being formed of an intermediate insulation sealed off to the outside by said collar, said intermediate seal suppressing transfer of sound conducted through solids and dampening vibrations and noise, said intermediate seal also absorbing pressure surges of predetermined magnitude; said collar being a seal during operation of the mill at pressures that are above atmospheric as well as below atmospheric; said intermediate seal comprising mineral wool in form of plate-shaped material; said collar being comprised of multi-layer elastic material with an aluminum coating thereon; fiber sealing mass above said intermediate seal towards the mill interior between said sealing ring housing and said mill housing, said intermediate seal being free of a ceramic cord.

9. A roller bowl mill comprising: a mill housing; a rotating vertically arranged grinding bowl within said housing; a plurality of grinding plate segments on said grinding bowl on which stationary grinding rollers are rollable; motor means for driving said grinding bowl through transmission means; a sealing ring housing arranged centrally relative to said grinding bowl and supported by a plurality of supports on said mill housing, said grinding bowl having a lower part passing through said mill housing and being sealed off relative to said mill housing by said sealing ring housing; a cam seal attached to a plate forming a floor of said sealing ring housing, said cam seal surrounding said lower part of said grinding bowl; metal rings arranged in a plurality of rows above each other in said cam seal; said sealing ring housing being stationary and enclosing said cam seal, part of said grinding bowl and a sealing air chamber having a sealing air connection; a gaseous medium under a pressure exceeding pressure existing within said mill being supplied to said sealing air chamber through said sealing air connection; said grinding bowl having a collar, said gaseous medium passing into said mill through a gap between said sealing ring housing and said collar; said mill housing having an adjacent part; an intermediate insulation means between said sealing ring housing and said adjacent part; said intermediate insulation comprising heat insulation material; a collar surrounding said intermediate insulation and forming a sealing ring clamped tightly to said adjacent part and to said sealing ring housing; said collar surrounding said intermediate insulation comprising a multi-layer elastic material with an aluminum coating; a fiber sealing mass above said intermediate insulation towards interior of said mill and between said sealing ring housing and said mill housing, said fiber sealing mass comprising a filler which insulates and filters for preventing exiting of dust; said intermediate insulation supressing transfer of sound conducted through solids and dampening vibrations and noise, said intermediate insulation also absorbing pressure surges of predetermined magnitude; said collar surrounding said intermediate insulation and comprising a seal during operation of the mill at pressures that are above atmospheric as well as below atmospheric; said intermediate insulation comprising mineral wool in form of plate-shaped material; said intermediate insulation comprising an element that is free of a ceramic cord.

* * * * *